US007885577B2

(12) United States Patent
Sugiyama

(10) Patent No.: US 7,885,577 B2
(45) Date of Patent: Feb. 8, 2011

(54) ROTATION TRANSMISSION DEVICE AND IMAGE FORMING APPARATUS

(75) Inventor: Keisuke Sugiyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 288 days.

(21) Appl. No.: 12/289,129

(22) Filed: Oct. 21, 2008

(65) Prior Publication Data

US 2009/0123183 A1 May 14, 2009

(30) Foreign Application Priority Data

Nov. 14, 2007 (JP) ..... 2007-295780

(51) Int. Cl.
*G03G 15/00* (2006.01)

(52) U.S. Cl. ..... 399/167; 399/301

(58) Field of Classification Search ..... 399/167, 399/116, 159, 301; 464/1, 23, 160
See application file for complete search history.

(56) References Cited

U.S. PATENT DOCUMENTS 5,905,927 A * 5/1999 Inoue et al. ..... 399/167
6,116,200 A * 9/2000 Abts et al. ..... 464/160
6,257,987 B1 * 7/2001 Lin
6,308,669 B1 * 10/2001 Lancefield et al. ..... 464/1
6,889,022 B2 * 5/2005 Ehara et al. ..... 399/167
7,376,375 B2 * 5/2008 Kobayashi et al. ..... 399/301
2006/0210313 A1 * 9/2006 Kosako ..... 399/167
2007/0201902 A1 * 8/2007 Murayama ..... 399/167
2008/0240754 A1 10/2008 Kobayashi

FOREIGN PATENT DOCUMENTS

JP 09-146329 6/1997
JP 2000-276030 10/2000
JP 2004-094204 3/2004

* cited by examiner

*Primary Examiner*—Susan S Lee
(74) *Attorney, Agent, or Firm*—Harness, Dickey & Pierce, P.L.C.

(57) ABSTRACT

A rotation transmission device including a driving member configured to input a driving force; a rotatable member; and a joint configured to transmit the driving force to the rotatable member, wherein the driving member, joint and rotatable member are coaxially arranged, and wherein the driving member are connected with the joint in such a manner that the phase of one-revolution fluctuation of the driving member is different from the phase of one-revolution fluctuation of the joint by an angle of π.

18 Claims, 19 Drawing Sheets

ROTATION TRANSMISSION DEVICE AND IMAGE FORMING APPARATUS

BACKGROUND OF THE INVENTION

1. Field of the Invention

The present invention relates to a rotation transmission device. In addition, the present invention also relates to an image forming apparatus, such as copiers, facsimiles, printers and complex machines having two or more of copying, printing and facsimiling functions, which uses a rotation transmission device.

2. Discussion of the Background

Recently, a need exists for a color image forming apparatus (such as copiers, printers, facsimiles and complex machines having two or more of copying, printing and facsimiling functions), which can produce high quality color images at a high speed. In attempting to fulfill the need, a tandem color image forming apparatus is provided, which has plural color image forming devices (such as black (K), magenta (M), cyan (C) and yellow (Y) color image forming devices) and in which plural color images formed by the color image forming devices are transferred to a receiving material borne on an endless image bearing member (transfer belt) optionally via an intermediate transfer medium to form a multiple or full color image on the receiving material. In this regard, it is preferable that each of the image forming devices is a process cartridge detachably attachable to the image forming apparatus because it becomes possible that when one of the image forming devices is damaged, only the image forming device is replaced with a new image forming device. In this case, a rotation transmission device including a joint for connecting a shaft of a rotation driving device with a shaft of a rotatable member is typically used for the image forming apparatus.

In such a color image forming apparatus as mentioned above, color toner images formed by the color image forming devices are sequentially transferred onto an intermediate transfer medium or a receiving material borne on a transfer belt, resulting in formation of a multiple or full color image. In this regard, when the color toner images are not transferred to proper positions of the receiving material or the intermediate transfer medium, the image quality of the resultant color image deteriorates, i.e., a color image with color misalignment in which color images are overlaid while misaligned is formed. For example, when an image (such as character images and solid images) is formed on a colored background, problems in that an edge portion of the image is formed on the colored background and a white portion is formed between the edges of the image and the colored background occur if the color misalignment problem is caused. When a character image is formed on a white background, the edge portion of the character image looks blurred. Thus, color misalignment deteriorates image qualities.

One of causes for such color misalignment is rotational fluctuation of rotating members (such as photoreceptor drums and transfer belts). Specifically, rotation of such rotating members fluctuates at the same cycle as the rotation cycle of the driving members (such as driving rollers) for driving the rotating members. For example, the main causes of the rotational fluctuation of a photoreceptor drum are transmission errors of the drive transmission device for the photoreceptor drum (such as eccentricity of gears, and cumulative pitch errors of gears); and transmission errors of a joint provided to connect the photoreceptor drum with the drive transmission device (such as inclination of the axis of the joint and eccentricity of the joint).

Next, the phase matching technique will be explained.

Color misalignment is caused as follows. For example, when a black color image and a magenta color image are overlaid (e.g., a magenta image is formed on a black color solid image), the resultant combined image has color misalignment if the amplitude and phase of the vibration component of rotational fluctuation of a rotating member (such as photoreceptor drums) used for forming the black color image are different from those of a rotating member used for forming the magenta color image. Specifically, the difference between the amplitudes of the rotational fluctuation causes positional misalignment of the black color image and the magenta color image, resulting in color misalignment. In attempting to solve the color misalignment problem, Japanese patent application publication No. (hereinafter referred to as JP-A) 09-146329 (corresponding to U.S. Pat. No. 5,881,346) proposes a technique such that pattern color images are formed on a transfer belt to detect positional misalignment of the color images, the phases of the vibration components of rotational fluctuations are determined on the basis of the detection results, and phase controlling is performed such that the phases of the vibration components of the rotating members for the color images are identical to each other to control the positional misalignment.

However, each of the drive transmission members used for forming different color images (such as K, M, C or Y color images) has individual error. Therefore, the amplitude of the vibration component of rotational fluctuation of a rotating member for forming images with a color is different from that of the corresponding rotating member for forming images with another color. In the image forming apparatus disclosed in JP-A 09-146329, each of the rotational phases of the rotating members for forming different color images is corrected so that the rotational phases are identical to each other. In this regard, if the amplitudes of rotational fluctuations of the rotating members for forming different color images are the same, occurrence of the color misalignment problem caused by positional misalignment of the different color images can be prevented by conforming the rotational phases. However, in reality the amplitudes are not the same. Therefore, even when the rotational phases are conformed, the difference between the amplitudes causes the color misalignment problem.

Next, the coupling technique will be explained.

In attempting to improve the rotation accuracy of a combination of plural rotating members and the positional accuracy thereof at the same time, various rotation transmission methods using a joint for transmitting rotation of a driving member provided in an image forming apparatus to a rotatable member of an image forming device set to the image forming apparatus have been proposed.

For example, JP-A 2004-94204 (corresponding to U.S. Pat. No. 6,968,144) discloses a rotation transmission device using an involute spline joint to improve the rotation accuracy. By using an involute spline joint, rotation fluctuation at the coupling can be decreased but rotation fluctuation of gears serving as a decelerator and the joint itself remains uncontrolled. Therefore, it is necessary for the technique to improve accuracy of the parts used therefor, resulting in increase of the costs thereof.

FIG. 1 is a schematic perspective view illustrating a background rotation transmission device. The background rotation transmission device includes a photoreceptor 1 having a shaft 2, a first joint 3 (i.e., a photoreceptor-side joint), a second joint 4 (i.e., a drive-side joint), a photoreceptor driving member 5, and a driving motor 6. The photoreceptor 1 is axially supported by the shaft 2. One end of the shaft 2 serves as the first joint 3. In such a rotation transmission device, the driving motor 6 (such as DC servo motors and stepping motors) inputs a driving force to the second joint 4 via the photoreceptor driving member 5. In this case, when the second joint 4 is engaged with the first joint 3, the photoreceptor 1 is rotated by the driving force.

In addition, JP-A 2000-276030 discloses a joint system for independently transmitting driving forces to a photoreceptor, a developing device, etc. This joint system uses a twisted triangle pole-form joint for transmitting a driving force to the photoreceptor. However, the joint system has a drawback in that rotation fluctuation of gears serving as a decelerator and the joint itself remains uncontrolled. Therefore, it is necessary for the system to improve accuracy of the parts, resulting in increase of the costs thereof.

Even when the rotation phase controlling proposed by JP-A 09-146329 is performed, the color misalignment caused by amplitude difference among the rotation members used for forming different color images remains. This color misalignment caused by the amplitude difference is a problem. In order to improve the image qualities by reducing the amplitude difference, it is necessary to improve the dimensional accuracies of the parts used for the rotation transmission device (joint) and/or to improve the calculation accuracy in rotation angular velocity controlling for the photoreceptors, but costs increase in any case.

Because of these reasons, a need exists for a rotation transmission device which can reduce the amount of color misalignment without using high-accuracy parts, i.e., without increasing costs.

SUMMARY OF THE INVENTION

As an aspect of the present invention, a rotation transmission device is provided, which includes:

a driving member configured to input a driving force;

a rotatable member; and a joint configured to transmit the driving force to the rotatable member, wherein the driving member, joint and rotatable member are coaxially arranged, and wherein the driving member are connected with the joint in such a manner that the phase of rotational fluctuation per one revolution (hereinafter referred to as one-revolution fluctuation) of the driving member is different from the phase of one-revolution fluctuation of the joint by an angle of $\pi$ (i.e., one of the phases is shifted by an angle of $\pi$ from the synchronized state in which both the phases are the same).

In a rotation transmission device in which plural rotation transmission units each including the above-mentioned driving member, joint and rotatable member are arranged in parallel, the above-mentioned phase shifting operation is performed on each rotation transmission unit to obtain plural synthesized one-revolution fluctuations (i.e., plural composite waveforms) In this regard, the rotation transmission unit having the maximum amplitude among the rotation transmission units is considered as a reference rotation transmission unit. The driving member and the joint of each of the other rotation transmission units are connected while adjusting the phases of the composite waveforms of one-revolution fluctuations thereof such that the amplitudes of the composite waveforms for the other rotation transmission units are substantially the same as the amplitude of the composite waveform for the reference rotation transmission unit.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
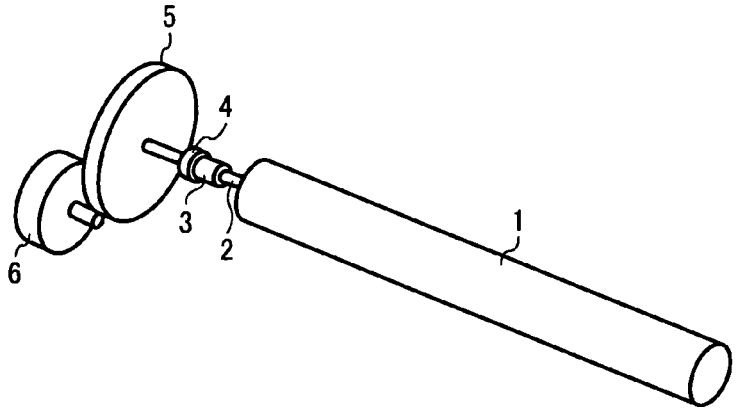
FIG. 1 BACKGROUND ART
FIG. 1 is a schematic perspective view illustrating a background rotation transmission device.
Figure 2:
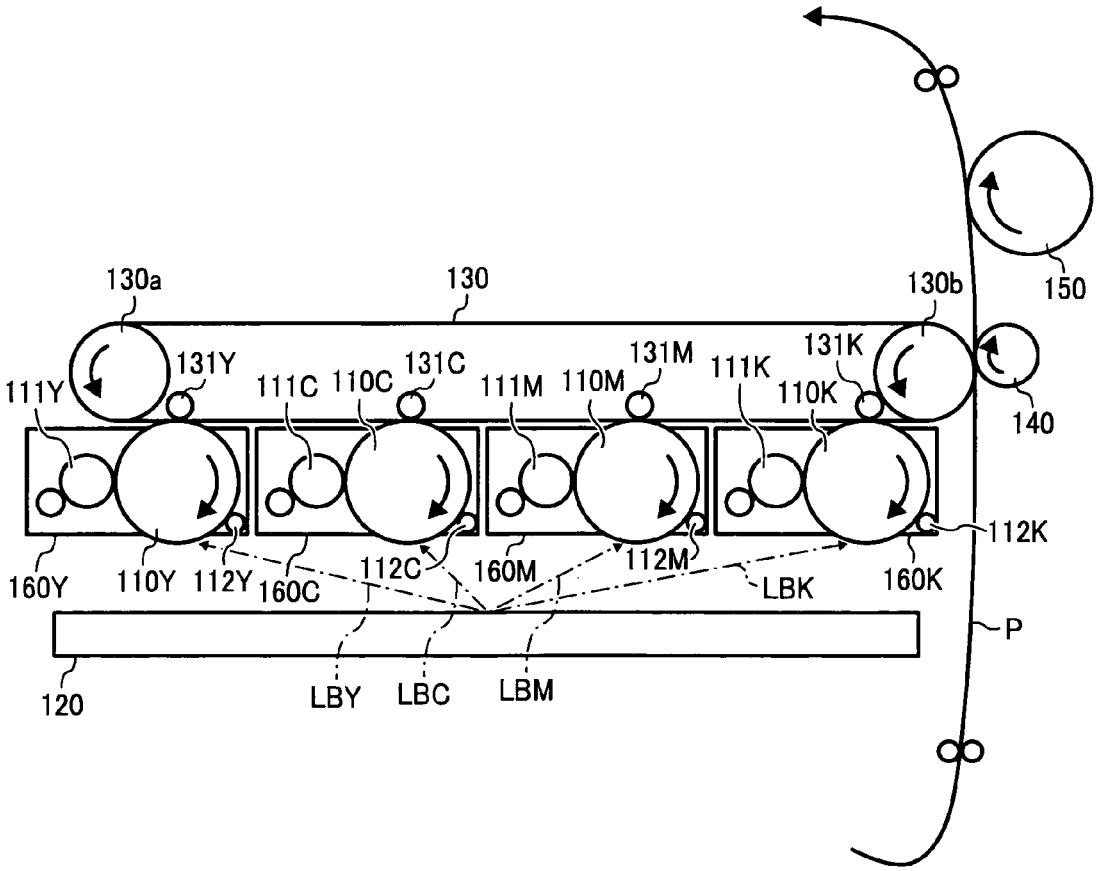
FIG. 2 is a schematic view illustrating the main portion of an example (a tandem color image forming apparatus) of the image forming apparatus of the present invention.

FIG. 2 illustrates the image forming portion of a tandem color image forming apparatus of an example of the present invention.

The image forming apparatus includes four photoreceptor drums 110 (110Y, 110C, 110M and 110K) each serving as an image bearing member, chargers 112 (112Y, 112C, 112M and 112K), developing rollers 111 (111Y, 111C, 111M and 111K) each serving as a developer bearing member of a developing device, a laser light irradiating device 120, an intermediate transfer belt 130, primary transfer rollers 131 (131Y, 131C, 131M and 131K), a secondary transfer roller 140, and a fixing roller 150 of a fixing device. Numeral 160 (160Y, 160C, 160M or 160K) denotes a process cartridge each including the photoreceptor drum 110 and another device such as the developing device including the developing roller 111. In this regard, the suffixes Y, C, M and K denote yellow, cyan, magenta and black colors, respectively.

The photoreceptor drums 110Y, 110C, 110M and 110K are used for forming yellow, cyan, magenta and black color images, respectively. Around the photoreceptor drums 110Y, 110C, 110M and 110K, respective image forming members such as the chargers 112Y, 112C, 112M and 112K, developing rollers 111Y, 111C, 111M and 111K, primary transfer rollers 131Y, 131C, 131M and 131K, cleaners (not shown), and dischargers (not shown) are arranged. In addition, the laser light irradiating device 120 irradiates the charged photoreceptor drums 110 with respective laser light beams LB (LBY, LBC, LBM and LBK) at light irradiating positions each located on a downstream side from the corresponding charger 112 relative to the rotating direction of the corresponding photoreceptor drum 110 indicated by an arrow.

The laser light irradiating device 120 scans the charged photoreceptor drums 110 in axial directions (i.e., main scanning direction) of the photoreceptor drums with laser beams LB, which are emitted from a light source (such as four laser diodes) while modulated to include Y, C, M and K image information, using a polygon mirror while the photoreceptor drums rotate in a directions (sub-scanning directions) indicated by respective arrows. Thus, electrostatic latent images corresponding to yellow, cyan, magenta and black color images are formed on the photoreceptor drums 110Y, 110C, 110M and 110K.

As illustrated in FIG. 2, the four process cartridges 160Y, 160C, 160M and 160K are detachably attached to the image forming apparatus as units. Each of the process cartridges 160 includes the photoreceptor drum 110, and at least one of the charger 112, the developing roller 111, a cleaner (not shown), and a discharger (not shown), together with driving mechanisms of these members.

The electrostatic latent images formed on the photoreceptor drums 110Y, 110C, 110M and 110K are developed with the respective developing rollers 111Y, 111C, 111M and 111K using yellow, cyan, magenta and black color toners, resulting in formation of yellow, cyan, magenta and black color images on the photoreceptors.

The photoreceptor drums 110Y, 110C, 110M and 110K are contacted with the intermediate transfer belt 130, which is tightly stretched by a driving roller 130*a* and a driven roller 130*b*. The yellow, cyan, magenta and black color toner images formed on the photoreceptors 110Y, 110C, 110M and 110K are sequentially transferred onto the proper positions of the intermediate transfer belt 130 by the respective primary transfer rollers 131Y, 131C, 131M and 131K, resulting in formation of a combined color toner image in which yellow, cyan, magenta and black color toner images are overlaid. The secondary transfer roller 140 is opposed to the driven roller 130*b* with the intermediate transfer belt 130 therebetween to form a secondary transfer nip. A receiving material P is fed toward the secondary transfer nip so that the combined color toner image on the intermediate transfer belt 130 is transferred onto the predetermined position of the receiving material P at the secondary transfer nip. Next, the combined color toner image on the receiving material P is heated and pressed by the fixing roller 150, which is located on a downstream side from the secondary transfer nip relative to the feeding direction of the receiving material P, resulting in fixation of the combined color toner image on the receiving material P. Thus, a full color image is formed on the receiving material P.

The image forming apparatus can form monochrome images, and two color images as well as full color images.

Next, rotation phase controlling (i.e., phase matching) will be explained.

Figure 3A:
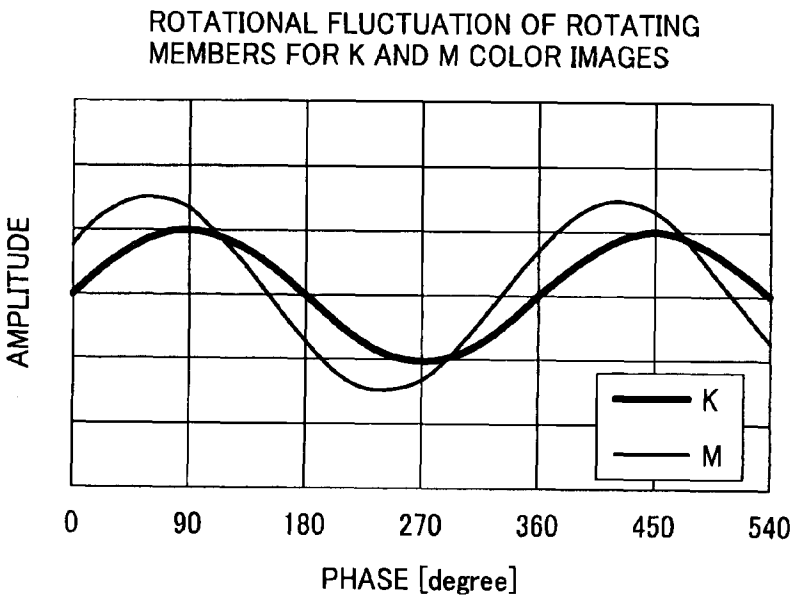
FIGS. 3-5 are graphs for explaining rotational fluctuation of rotatable members for forming black and magenta color images.
Figure 3B:
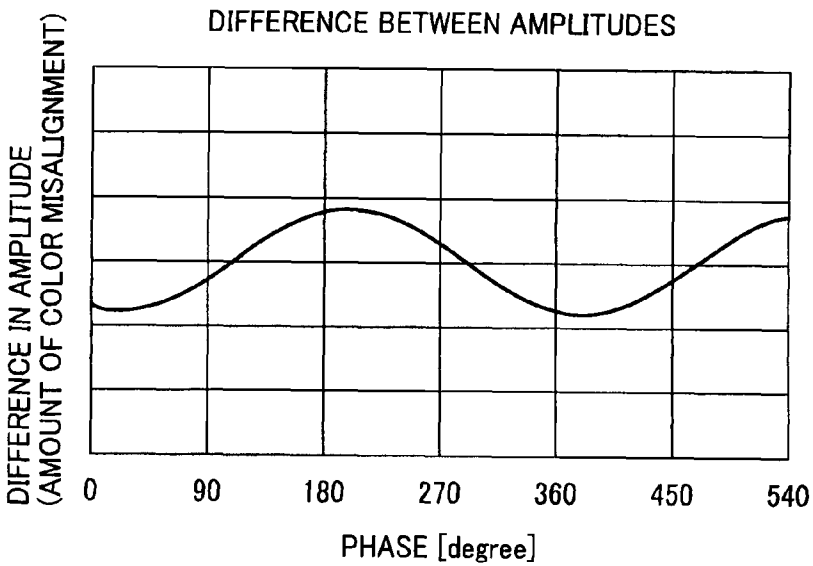
Figure 4A:
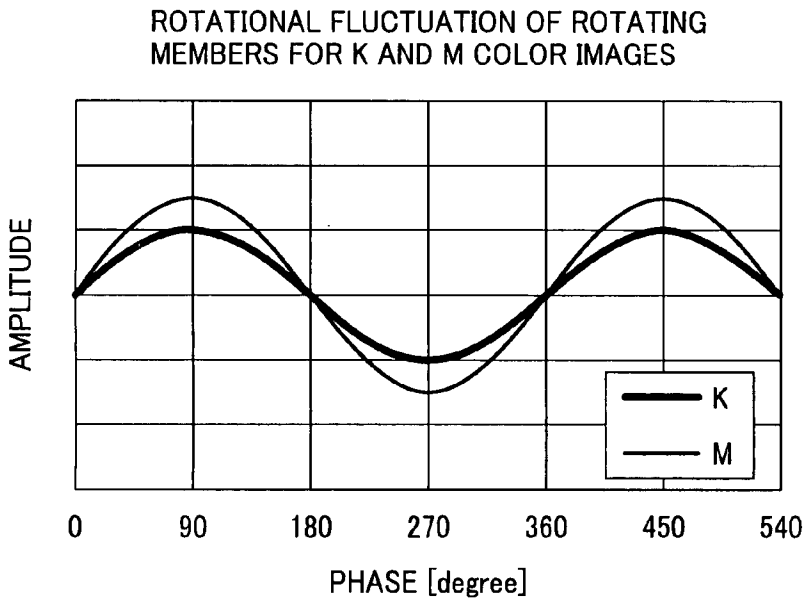
Figure 4B:
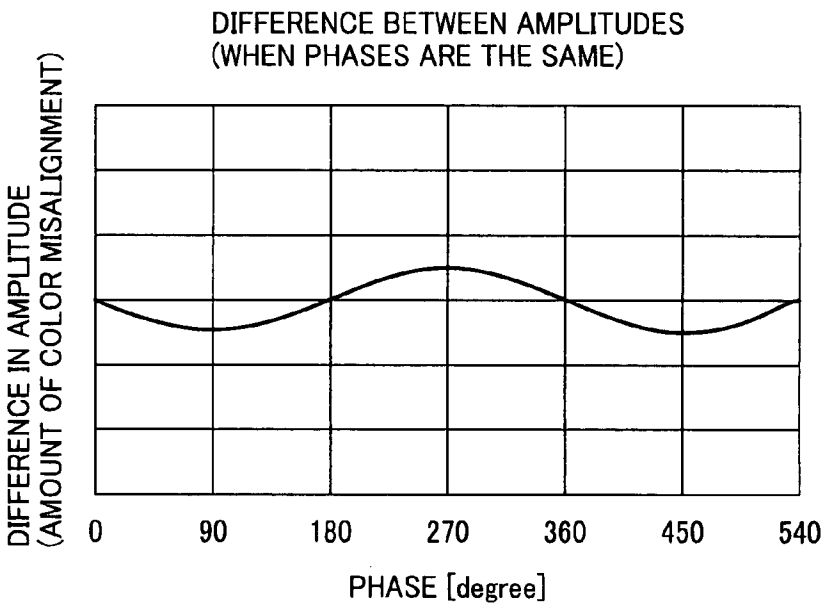
Figure 5A:
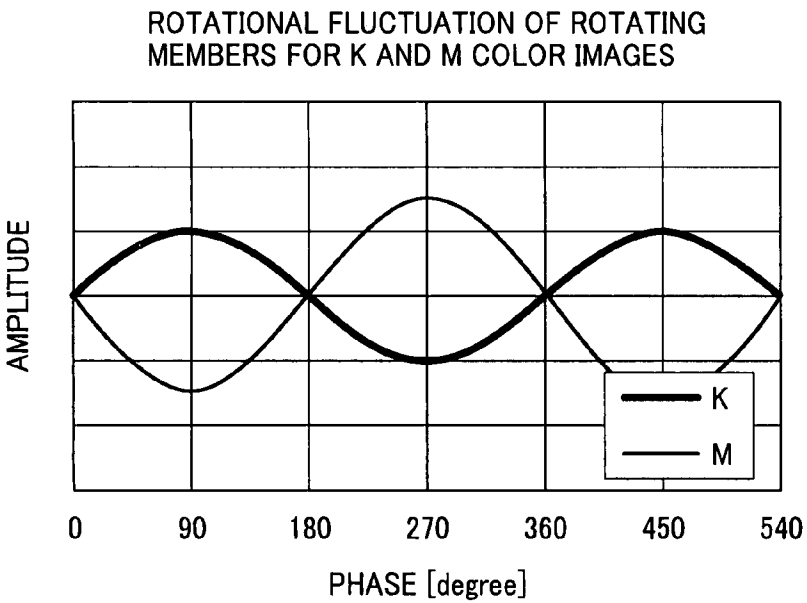
Figure 5B:
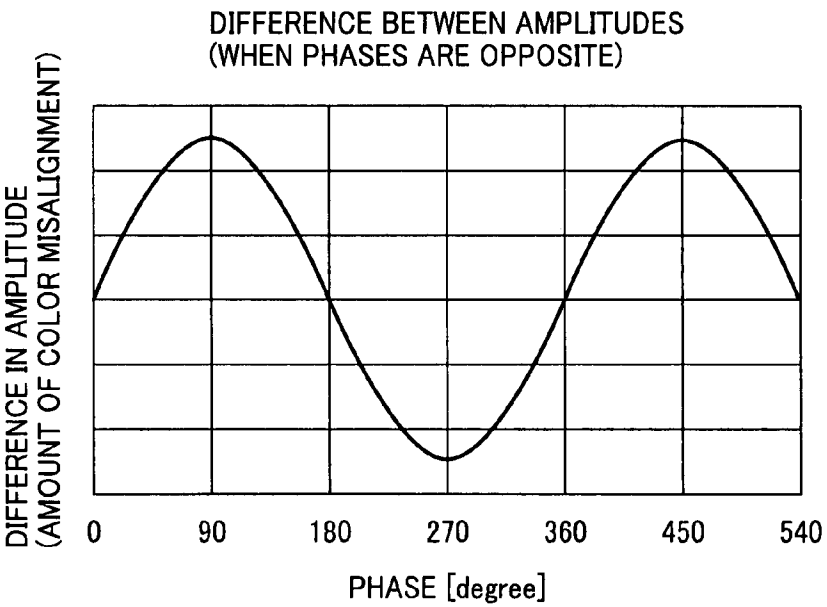

FIGS. 3-5 are graphs for explaining rotational fluctuations of rotating members used for forming two different color images (in this case, magenta (M) and black (K) color images) FIGS. 3A, 4A and 5A illustrate rotational fluctuations of the rotating members, and FIGS. 3B, 4B and 5B illustrate differences between the amplitudes of rotational fluctuations of the rotating members (i.e., amplitude residual).

The method for preventing occurrence of the color misalignment problem using a rotation phase controlling technique will be explained.

In this example, explanation is made while assuming that a two-color image consisting of a black (K) color image and a magenta (M) color image is formed. The rotational fluctuations of a rotating member (such as photoreceptor drums) used for forming K color images (hereinafter referred to as a K-color rotating member) and the corresponding rotating member used for forming M color images (hereinafter referred to as an M-color rotating member) are illustrated in FIG. 3A. In FIG. 3A, the waveform shown with a thick line represents the rotational fluctuation of the K-color rotating member, and the waveform shown with a thin line represents the rotational fluctuation of the M-color rotating member. It is clear that the amplitude and phase of the waveform of the K-color rotating member are different from the amplitude and phase of the waveform of the M-color rotating member. The difference between the amplitudes of the waveforms K and M illustrated in FIG. 3A is illustrated in FIG. 3B. Therefore, the formed K-color image and M-color image are different in position, resulting in occurrence of the color misalignment problem.

When phase controlling is performed such that the phases of the waveforms K and M become identical to each other as illustrated in FIG. 4A, the difference in amplitude (i.e., amplitude residual) is minimized, namely, the amount of color misalignment can be minimized as illustrated in FIG. 4B. If the wave form M is shifted from the synchronized state (illustrated in FIG. 4A) by an angle of $\pi$ as illustrated in FIG. 5A, the difference in amplitude (i.e., amplitude residual) is maximized, namely, the amount of color misalignment is maximized as illustrated in FIG. 5B.

Therefore, it is preferable to perform phase controlling such that the phases of the waveforms K and M are identical to each other as illustrated in FIG. 4A. The specific method therefor is as follows.

At first, pattern images (Y, C, M and K color images) are formed on a transfer belt to determine the registration accuracy. Next, the phases of vibrating components of the rotational fluctuations of the rotating members used for forming Y, C, M and K color images are determined on the basis of the data for the pattern images. Further, the rotation stopping positions of the driving sources used for the rotating members are adjusted so that the phases of vibrating components are identical to each other as illustrated in FIG. 4A. In a tandem 4-color image forming apparatus, rotation phase controlling is performed such that all the four phases of vibrating components are identical to each other.

In this regard, the drive transmission members constituting the Y, C, M and K color image forming devices have own errors. Therefore, the amplitudes of vibrating components of rotational fluctuations thereof are not identical to each other. Thus, occurrence of color misalignment caused by the difference in phase of vibrating components can be prevented, but occurrence of color misalignment caused by the difference in amplitude cannot be prevented.

Next, the rotation transmission device will be explained.

Figure 6:
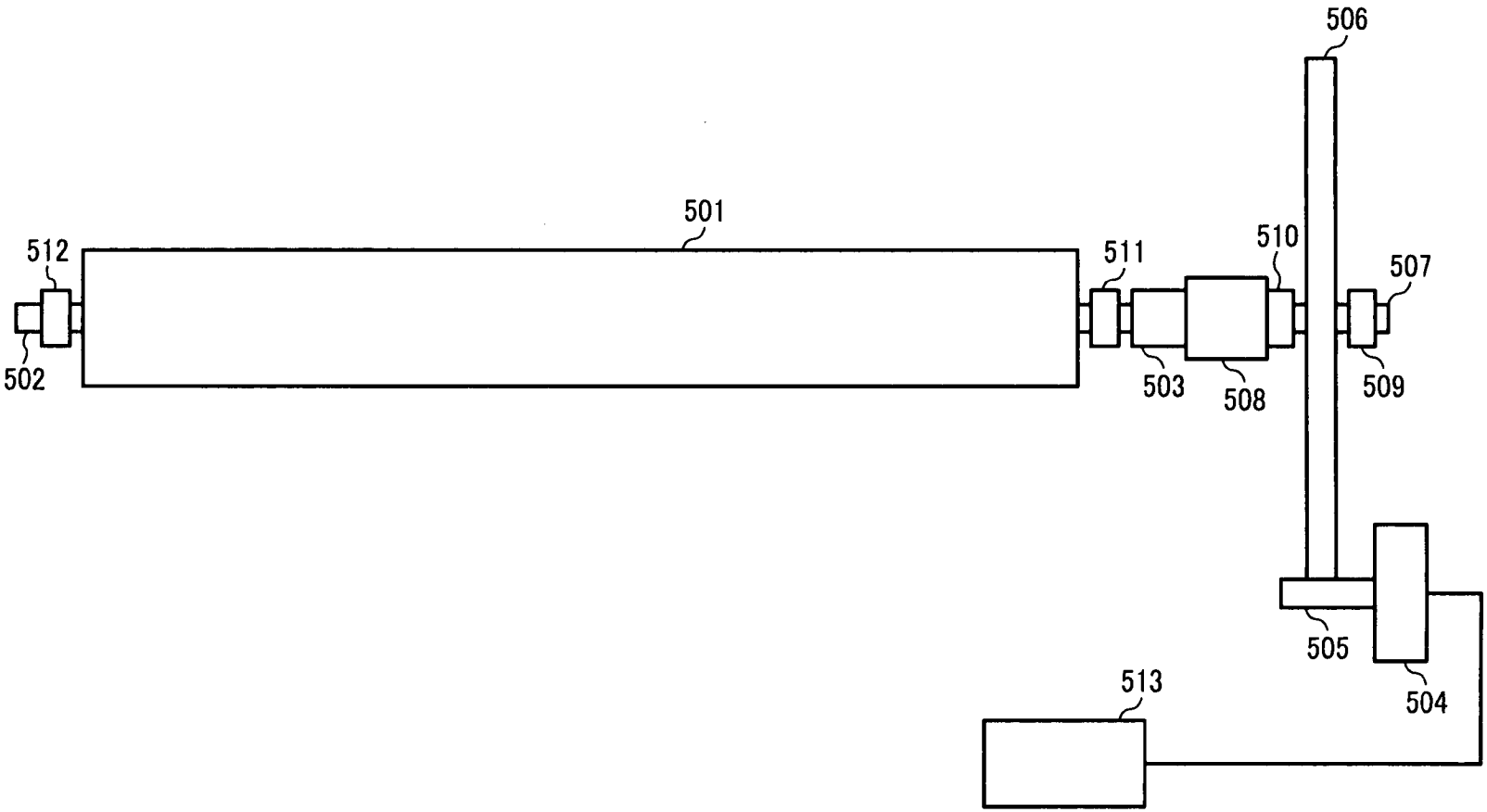
FIG. 6 is a schematic view illustrating an example of the rotation transmission device for transmitting a driving force to a photoreceptor.

FIG. 6 is a schematic view illustrating a rotation transmission device of the present invention for transmitting a driving force of a driving motor to a photoreceptor.

Referring to FIG. 6, numeral 501 denotes a photoreceptor drum, which has a shaft 502. Numeral 503 denotes a photoreceptor-side joint, and numeral 504 denotes a driving motor having a motor gear 505. Numeral 506 denotes a driving gear serving as a driving member, and numeral 507 denotes a driving shaft. Numeral 508 denotes a drive-side joint, and numerals 509, 510, 511, and 512 denote bearings. The combination of the photoreceptor-side joint and the drive-side joint are hereinafter sometimes referred to as a joint.

FIG. 6 illustrates an example of the rotation transmission device of the present invention for transmitting a driving force to the photoreceptor. The photoreceptor drum 501 is rotatably supported by the bearings 511 and 512, which are engaged with a frame (not shown) of the main body of the image forming apparatus. The photoreceptor-side joint 503 is provided on one end of the shaft 502 of the photoreceptor drum 501.

The driving motor 504 is, for example, a DC servo motor, a stepping motor, or the like. The driving force of the driving motor 504 is transmitted to the driving gear 506, which is provided on the shaft 502 and which is engaged with the motor gear 505. The driving shaft 507 of the driving gear 506 is rotatably supported by the bearings 509 and 510, which are engaged with a frame (not shown) of the main body of the image forming apparatus. The drive-side joint 508 is provided on one side of the driving shaft 507. When the drive-side joint 508 is engaged with the photoreceptor-side joint 503, the driving force of the driving motor 504 can be transmitted to the photoreceptor drum 501. By using the rotation transmission device having such a structure as illustrated in FIG. 6, the number of parts used for constituting the device can be reduced, and the transmission errors can be minimized. Therefore, the photoreceptor drum can be rotated with high precision.

As mentioned above, rotation phase controlling is performed on the signal input to the driving motor 504. Specifically, the phases of vibrating components of the rotational fluctuations of the rotating members used for forming Y, C, M and K color images are determined on the basis of the data for the pattern images formed on the transfer belt. In addition, the rotation stopping positions of the driving sources used for the rotating members are adjusted so that the phases of vibrating components are identical to each other as illustrated in FIG. 4A. As illustrated in FIG. 6, the rotation phase controlling is performed by a controller 513. In the rotation phase controlling, the controller 513 inputs a signal to the driving motor 504 after performing an arithmetical operation.

Figure 7:
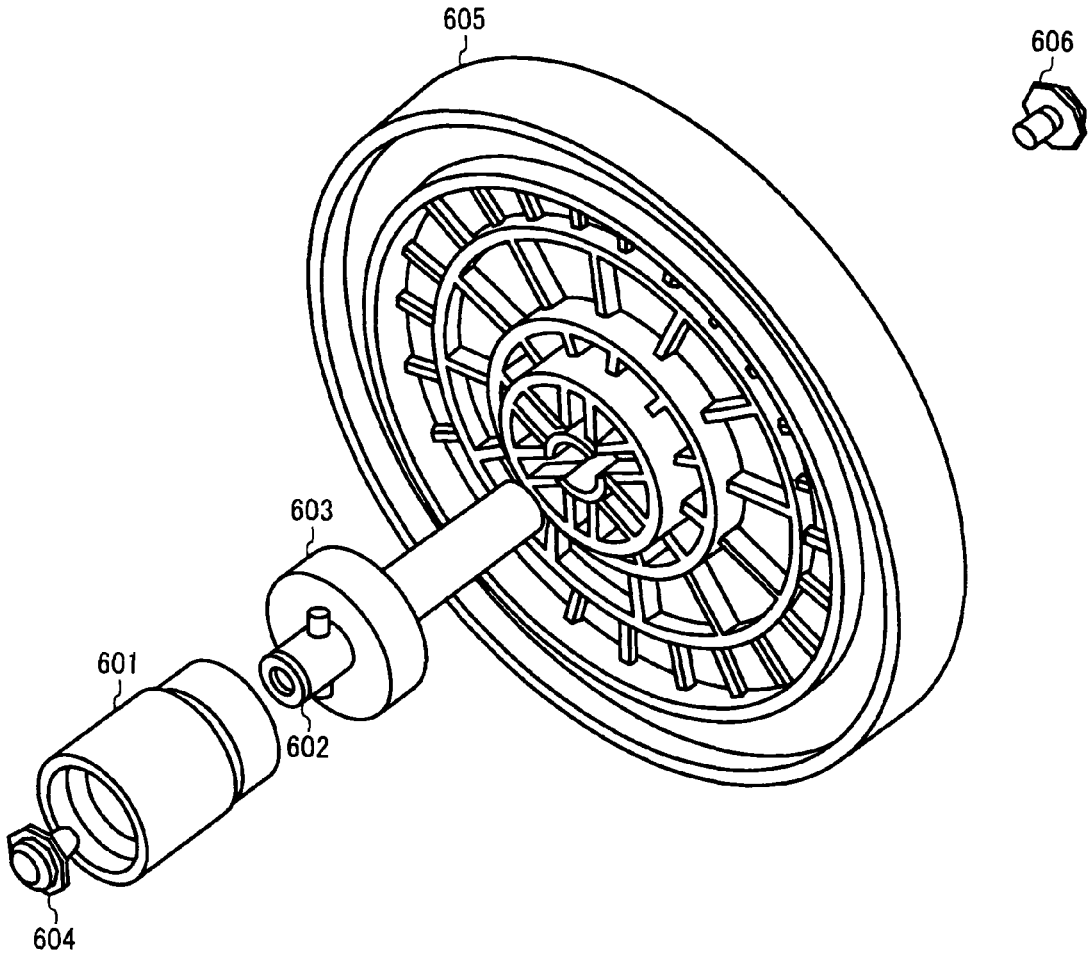
FIGS. 7 and 8 are schematic views illustrating joints of the rotation transmission device of the present invention.

FIG. 7 illustrates an example of the rotation transmission device of the present invention. Referring to FIG. 7, numerals 601, 602 and 603 respectively denote a joint, a rotary shaft and a locking member. Numerals 604 and 606 denote fastening screws serving as push-fastening members, and numeral 605 denotes a reduction gear. In this regard, the combination of the locking member 603 with the push-fastening member 604, and the combination of the locking member 603 with the push-fastening member 606 are referred to as a rotation stopper.

The movement of the joint 601 in the thrust direction of the rotary shaft 602 is regulated by the locking member 603. Since the joint 601 receives a force in the thrust direction by the push-fastening member 604, the joint is fixed to the rotary shaft 602. Similarly, the movement of the reduction gear 605 in the thrust direction of the rotary shaft is regulated by the locking member 603. Since the reduction gear 605 receives a force in the thrust direction by the push-fastening member 606, the reduction gear 605 is fixed to the rotary shaft 602 so as to be coaxial with the joint 601.

The decelerator illustrated in FIGS. 6 and 7 uses a gear, but is not limited thereto. For example, decelerators using a belt and a pulley can also be used. Therefore, the decelerator (gears and pulleys) is hereinafter referred to as a driving member.

Figure 8:
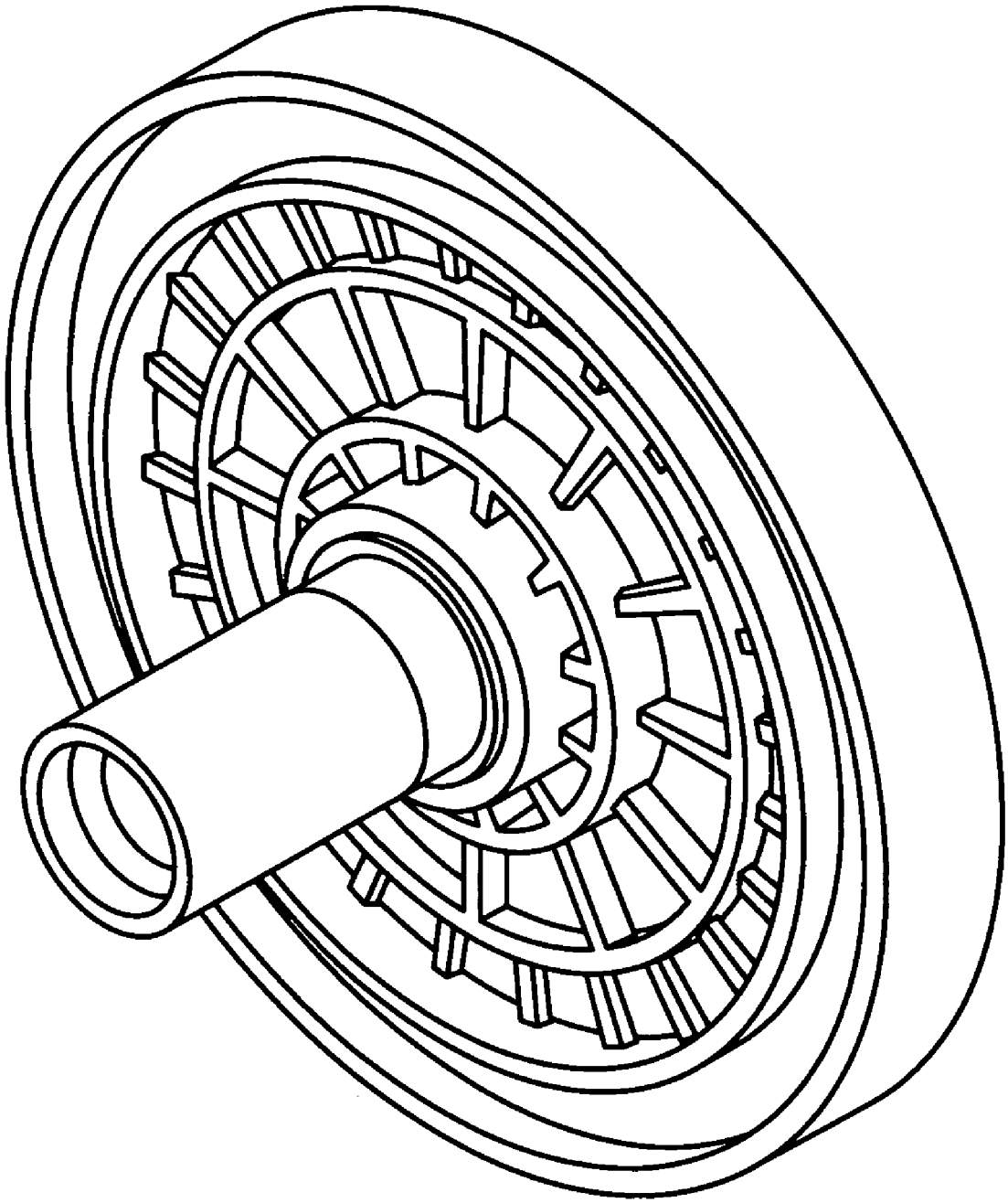

FIG. 8 illustrates another example of the rotation transmission device of the present invention.

The rotation transmission device includes a rotation transmission member in which a joint and a reduction gear are integrally molded so as to be coaxial. By integrally molding a joint and a reduction gear, the number of parts can be reduced, resulting in reduction of costs. In addition, accumulation of dimensional errors of plural parts, and occurrence of assembling errors can be prevented. Therefore, rotational fluctuation of the rotating member (such as photoreceptors) can be reduced, which leads to production of high quality images.

The reduction gear may be a timing pulley. In addition, joints, reduction gears, and timing pulleys can be prepared using known methods such as cutting and injection molding.

In this regard, parts such as gears and joints have geometric tolerances such as tooth errors and coaxiality errors, and dimensional tolerance such as variations of inside and outside diameters. Therefore, such parts have periodic fluctuation having a period corresponding to one revolution thereof. Therefore, when a part such as reduction gears and joints is used for a drive transmission mechanism of a rotating member such as photoreceptor drums, the rotational fluctuation of the part itself is added to the rotational fluctuation of the rotating member. By improving the accuracy of such a part, the periodic fluctuation can be reduced but costs increase.

Since a driving gear and a joint are arranged so as to be coaxial and are rotated at the same revolution, the periodic fluctuations of the driving gear and joint are synthesized. The synthesis of the periodic fluctuations will be explained in detail by reference to drawings.

Figure 9B:
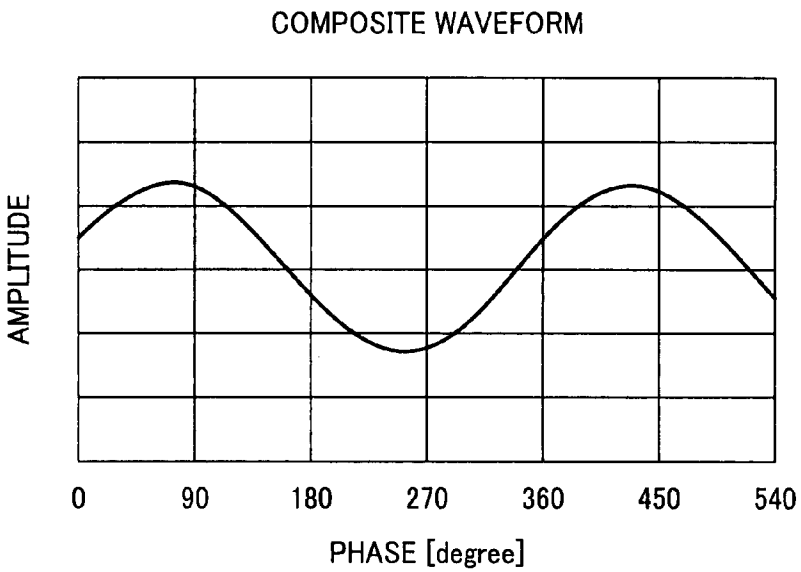
FIGS. 9-11 are graphs for explaining rotational fluctuation of a reduction gear and a joint.
Figure 9A:
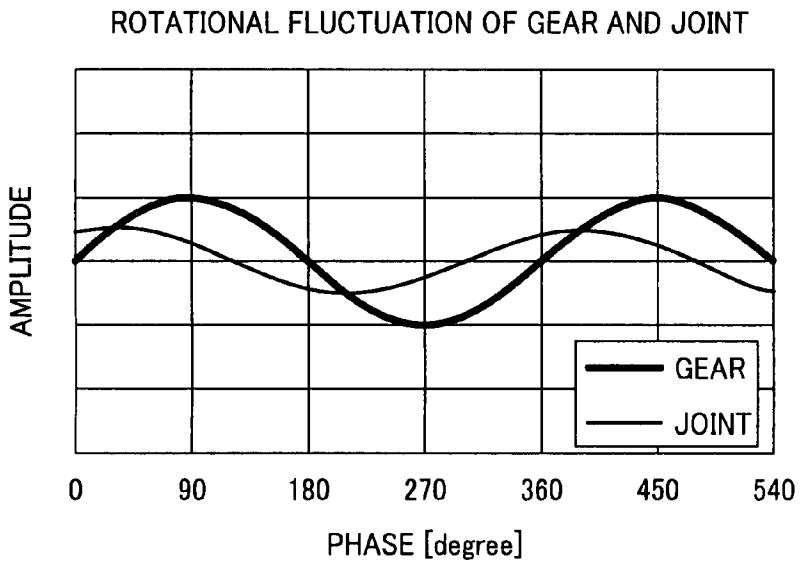
Figure 10B:
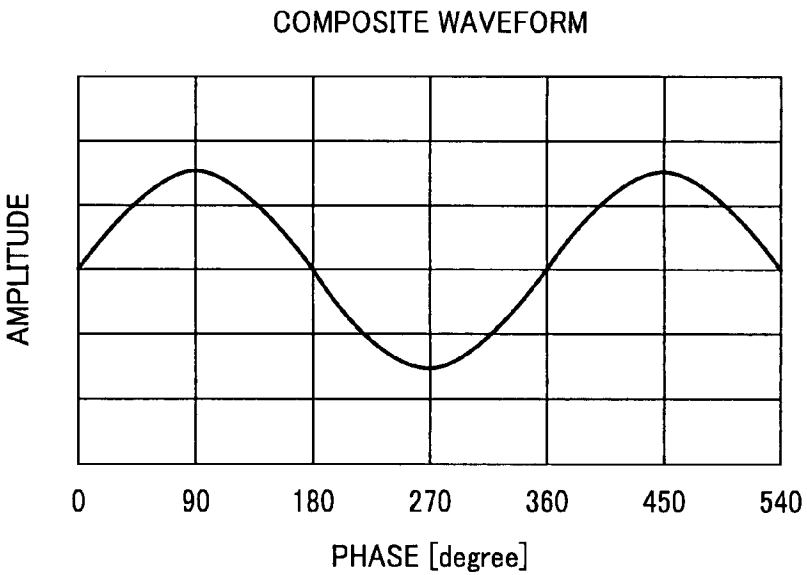
Figure 10A:
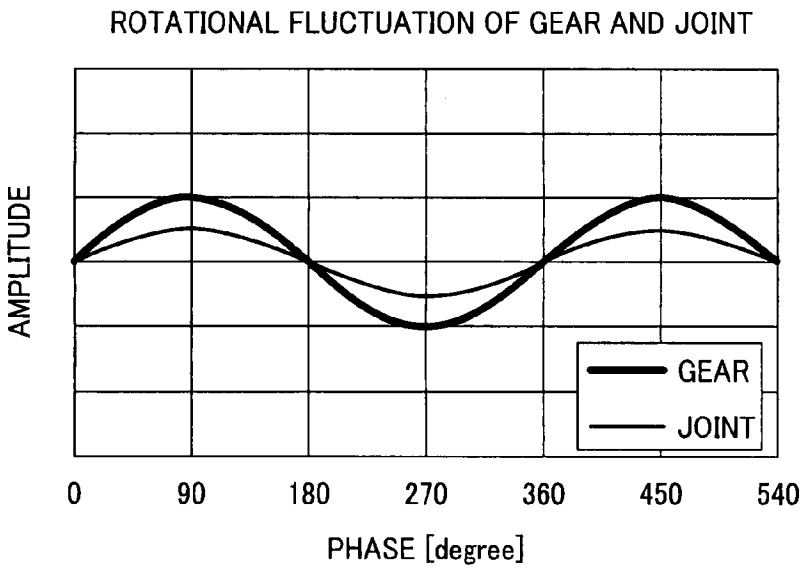
Figure 11B:
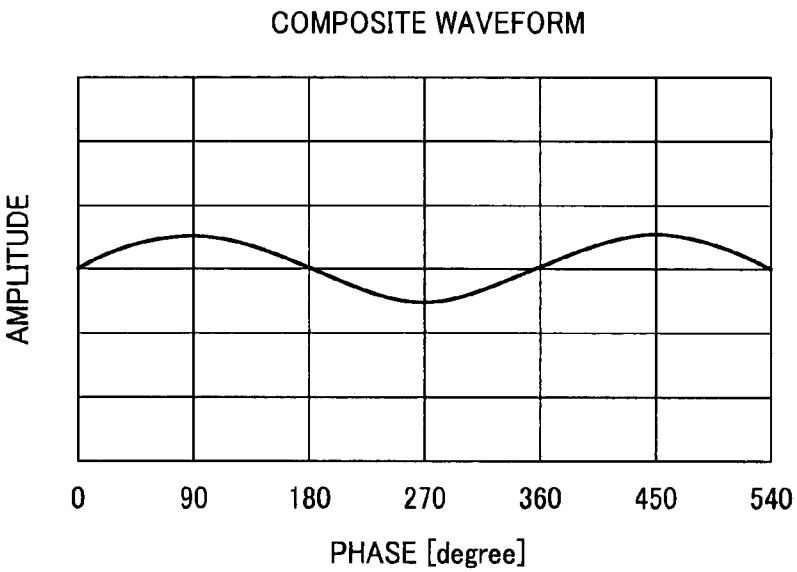
Figure 11A:
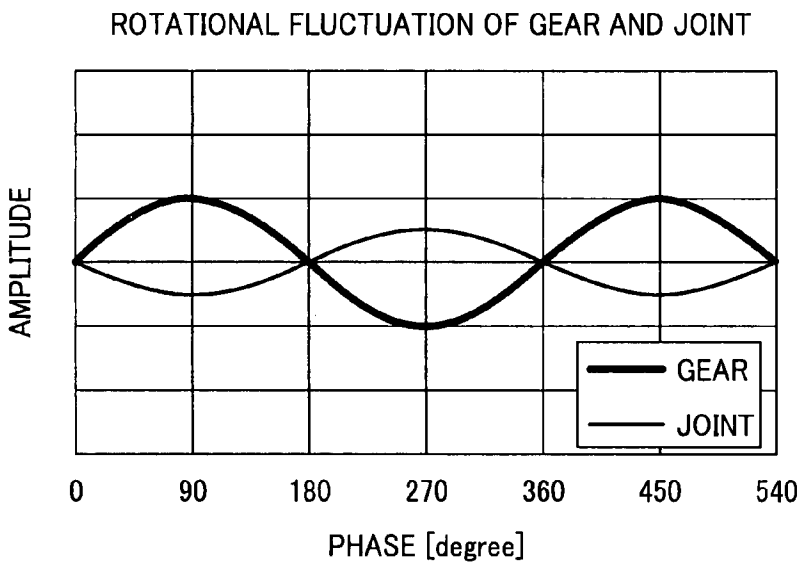

FIGS. 9A, 10A and 11A are graphs illustrating rotational fluctuations of a driving gear and a joint. FIGS. 9B, 10B and 11B are graphs illustrating composite waveforms of the waveforms illustrated in 9A, 10A and 11A, respectively.

Referring to FIG. 9A, the waveform of rotational fluctuation of the driving gear is shown with a thick line, and the waveform of rotational fluctuation of the joint is shown with a thin line. When the driving gear and the joint, which are arranged so as to be coaxial, are rotated at the same revolution, the rotational fluctuation of the rotation transmission mechanism (i.e., the synthesized rotational fluctuation of the combination of the driving gear and the joint) is represented by the composite waveform illustrated in FIG. 9B.

When the phase of waveform of rotational fluctuation of the driving gear is identical to that of the joint as illustrated in FIG. 10A, the amplitude of the composite waveform is maximized as illustrated in FIG. 10B. In contrast, when the phase of waveform of rotational fluctuation of the driving gear is different by an angle of $\pi$ from that of the joint as illustrated in FIG. 11A, the amplitude of the composite waveform is minimized as illustrated in FIG. 11B.

Therefore, it is preferable to assemble a reduction gear and a joint in such a manner that the phase of rotational fluctuation of one of the reduction gear and the joint is different by an angle of $\pi$ from that of the other of the reduction gear and the joint. In this case, the amplitude of the composite waveform of rotational fluctuation of the rotation transmission device can be minimized.

When a part (such as driving gears and joints) is prepared by cutting, the one-revolution fluctuation (i.e., rotational fluctuation per one revolution) of each of products of the part is measured. When a part is prepared by a resin molding method using the same cavity and core, the one-revolution fluctuation of only one product of the part is measured. This is because the one-revolution fluctuation of the part mainly depends on the variation of the cavity and core used and variation of one-revolution fluctuation of the products of the part produced using one cavity and one core is small.

When the rotation transmission device illustrated in FIG. 7 is assembled, the driving gear and the joint are set such that the phase of rotational fluctuation of one of the gear and the joint is different by an angle of $\pi$ from that of the other. The specific assembling method is as follows.

At first, the one-revolution fluctuations of the gear and the joint used for assembling are measured. In this regard, it is preferable that, for example, a mark is formed on a position of each of the parts at which the amplitude of the rotational fluctuation has a maximum value. Next, the parts (gear and joint) are assembled in such a manner that the phases of rotation fluctuations thereof are different from the other by an angle of π. Thus, assembling can be easily performed.

In the case of the rotation transmission device illustrated in FIG. 8, at first the driving gear and the joint are prepared by an integral molding method. Next, the rotation fluctuation of each of the driving gear portion and the joint portion is measured. According to the rotation fluctuation information, molding is performed while adjusting the cavity (i.e., molding tool) such that the phases of the rotation fluctuations of the driving gear and the joint are different from the other by an angle of π. Thus, assembling can be easily performed.

By using such a rotation transmission device as mentioned above for an image forming apparatus, the amplitude of one-revolution fluctuation of a rotating member (such as photoreceptor drums) for forming a color image can be minimized. Therefore, the amount of positional misalignment of plural color images in a combined color image can be minimized, resulting in minimization of degree of color misalignment.

Next, a case of an image forming apparatus having plural rotation transmission devices each having a driving gear and a joint will be explained.

As for the rotation transmission device (hereinafter referred to as a rotation transmission device A) having the largest amplitude of one-revolution fluctuation among the plural rotation transmission devices, the above-mentioned method (i.e. changing the phases of rotation fluctuation so as to be different from the other by an angle of π) is applied thereto to minimized the amplitude. As for each of the other rotation transmission devices, the phases of one-revolution fluctuation of the joint is differentiated at a proper angle from the phase of one-revolution fluctuation of the gear such that the amplitude of the resultant composite waveform of the rotation fluctuations of the joint and the gear of the rotation transmission device is the same as that of the device A. Next, the rotation phase controlling mentioned above is performed on the image forming apparatus such that the phases of the composite waveforms of the plural rotation transmission devices are identical to each other to minimize the amount of color misalignment.

FIGS. 12-15 are graphs used for explaining the way to match the amplitudes of the composite waveforms of plural rotation transmission devices.

Figure 12B:
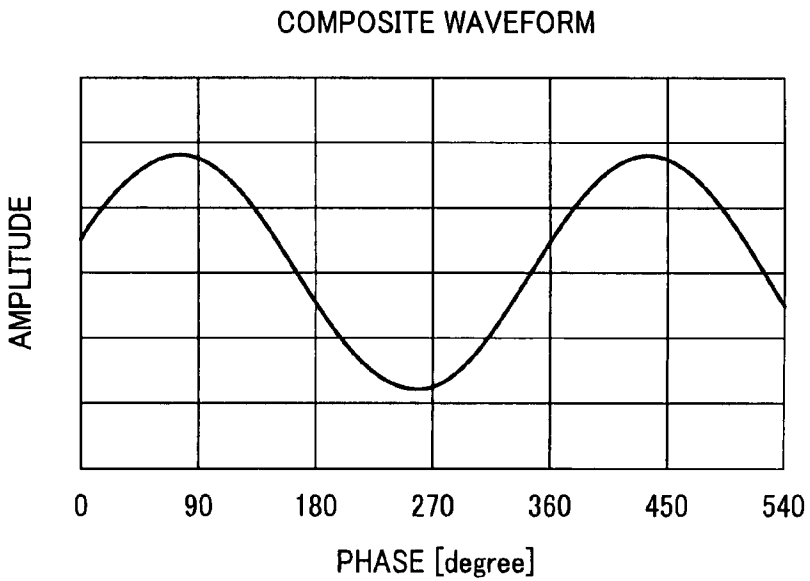
FIGS. 12-15 are graphs for explaining the way to match the amplitudes of the composite waveforms of one-revolution fluctuations of plural rotation transmission devices.
Figure 12A:
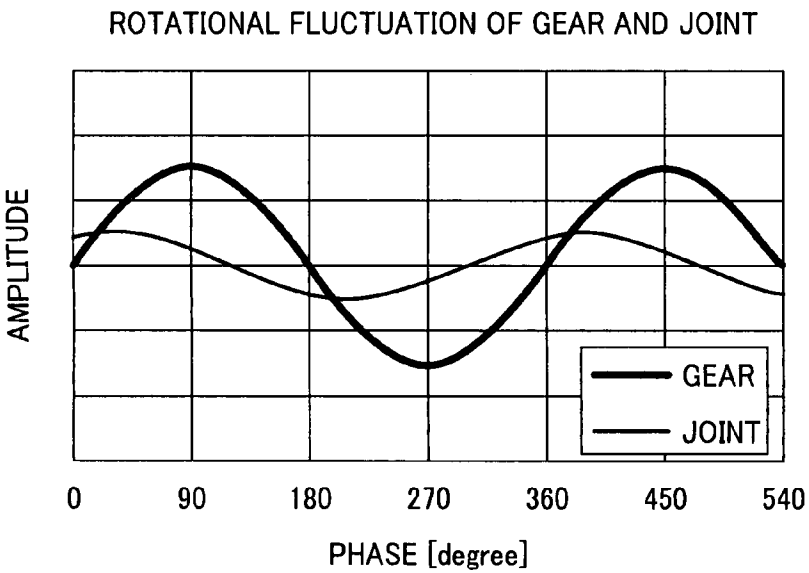
Figure 13B:
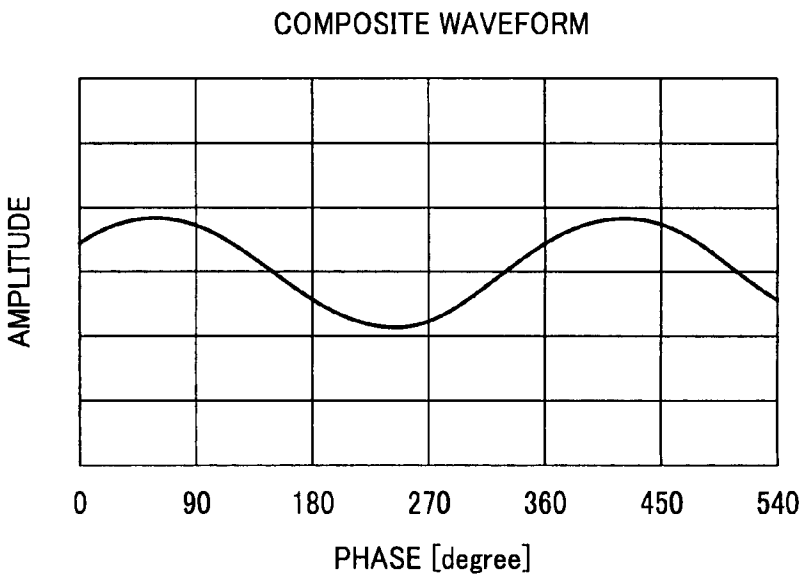
Figure 13A:
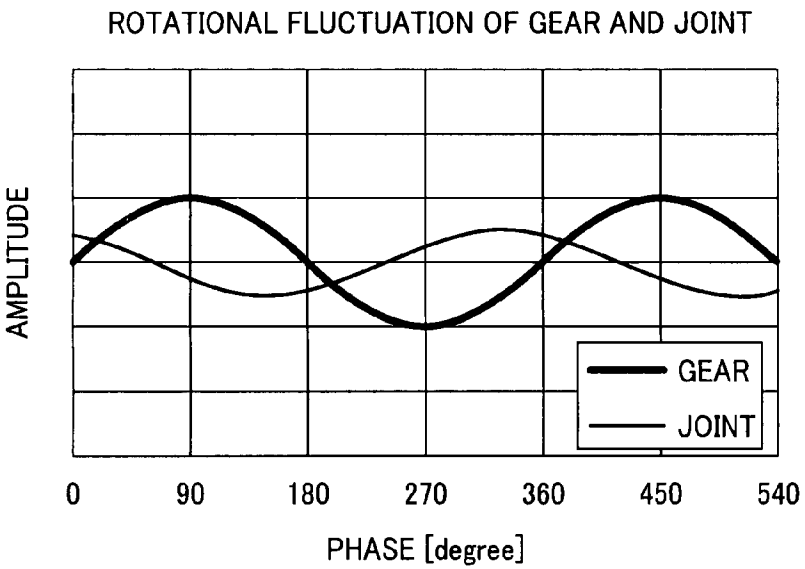

FIGS. 12A and 13A are graphs respectively illustrating rotational fluctuations of a driving gear and a joint of the rotation transmission device A having the largest amplitude of one-revolution fluctuation and another rotation transmission device B having an amplitude of one-revolution fluctuation smaller than the rotation transmission device A. FIGS. 12B and 13B are graphs respectively illustrating composite waveforms of the waveforms illustrated in 12A and 13A.

Figure 14B:
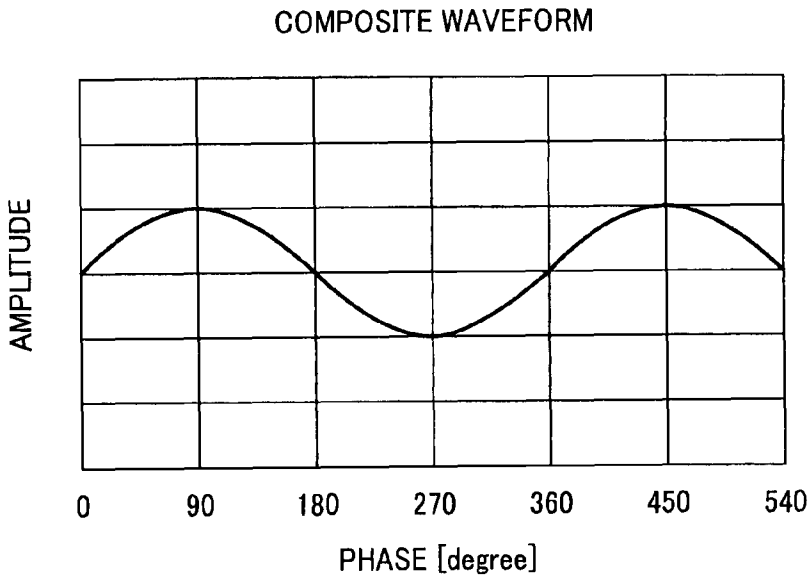
Figure 14A:
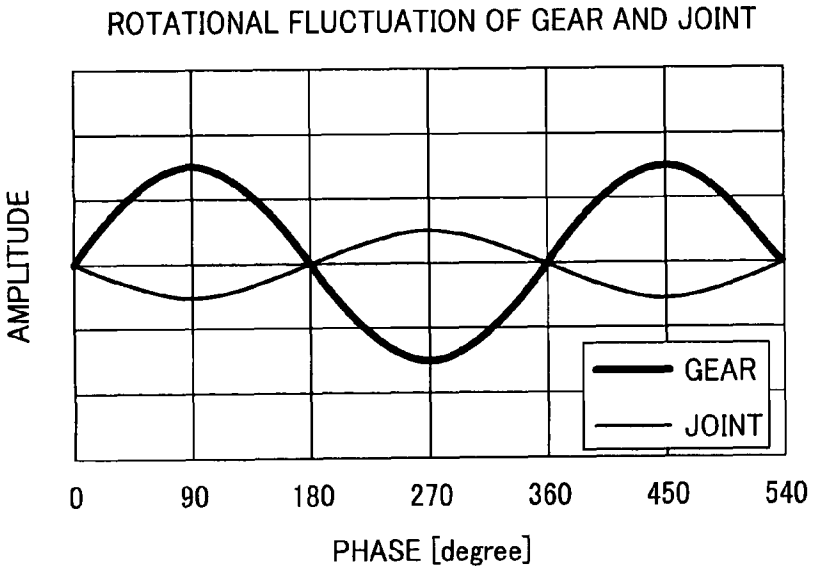
Figure 15B:
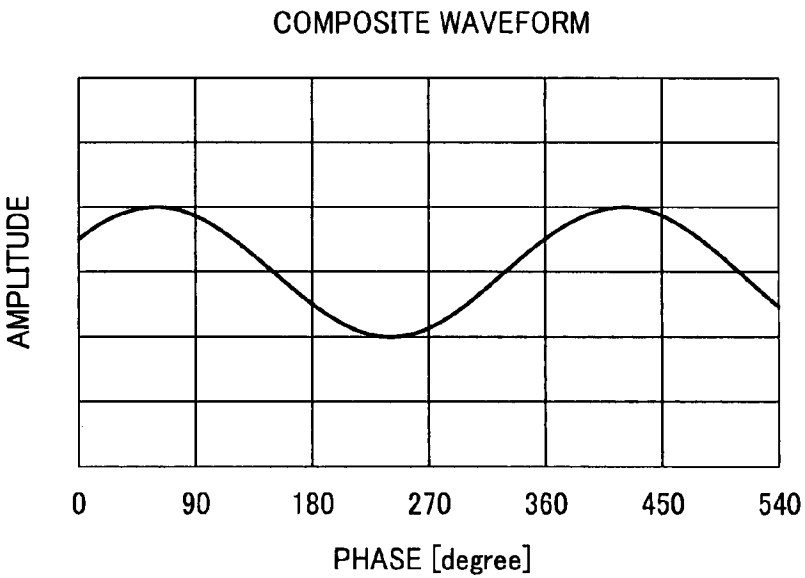
Figure 15A:
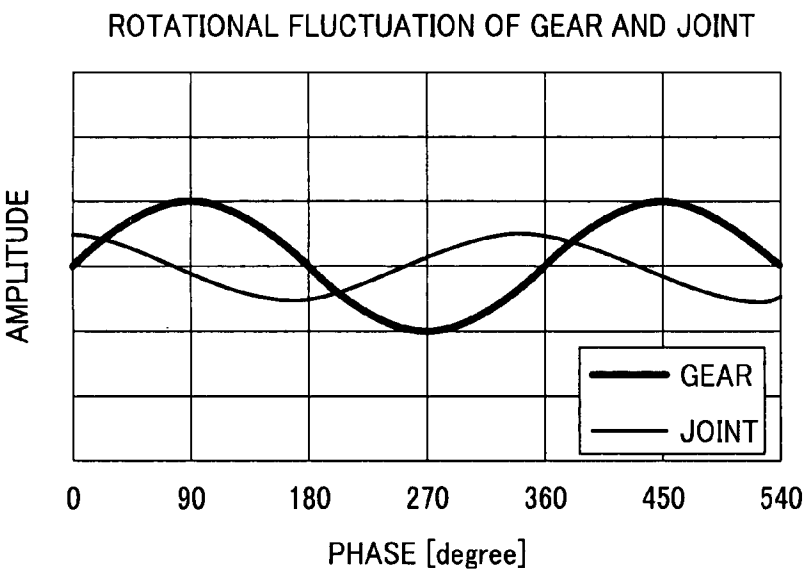

With respect to the rotation transmission device A, one of the phases of one-revolution fluctuations of the gear and the joint is shifted so as to be different from the other by an angle of π as illustrated in FIG. 14A. With respect to the rotation transmission device B, one of the phases of one-revolution fluctuations of the gear and the joint (i.e., in this case, the phase of one-revolution fluctuation of the joint) is properly shifted as illustrated in FIG. 15A such that the amplitude of the composite waveform (illustrated in FIG. 15B) is the same as the amplitude of the composite waveform (illustrated in FIG. 14B) of the rotation transmission device A. In FIG. 15A, the phase shift amount, i.e., the phase difference between the two waveforms, is 105°.

Therefore, when the rotation transmission device illustrated in FIG. 7 is used, the reduction gear and the joint are set such that the phases of one-revolution fluctuations of the driving gear and the joint are different from each other by 105°. When the rotation transmission device illustrated in FIG. 8 is used, molding is performed while adjusting the cavity (i.e., molding tool) such that the phases of one-revolution fluctuations of the driving gear and the joint are different from each other by 105°.

By using this method, the difference between amplitudes of rotation fluctuations of plural rotation transmission devices can be minimized, resulting in minimization of degree of color misalignment.

Figure 16:
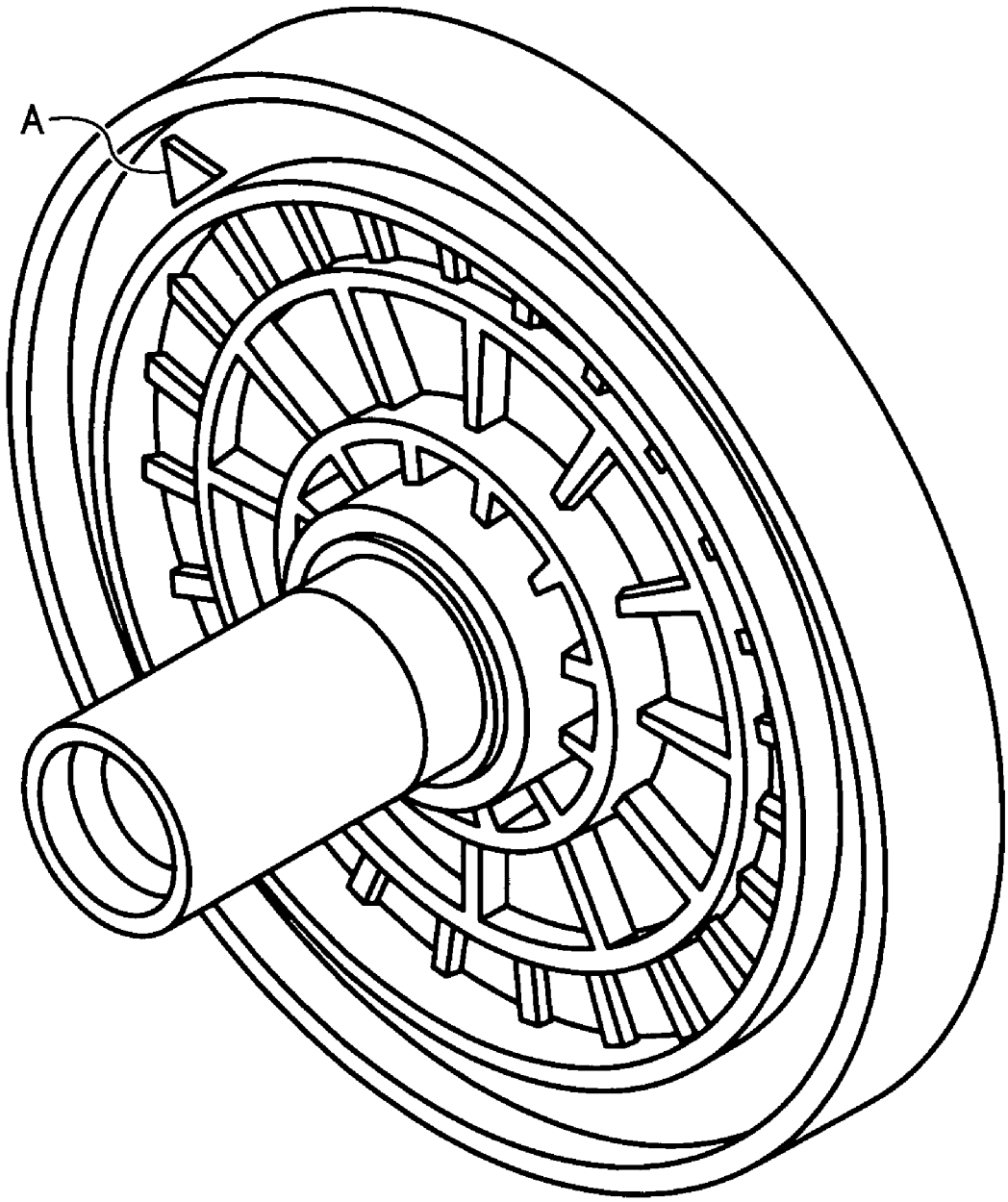
FIGS. 16 and 17 are schematic views each illustrating a mark on a molded resin gear for use in phase matching.

As mentioned above, it is preferable to match the phases of the composite wave form (illustrated in FIG. 14B) of the device A with the phase of the composite waveform (illustrated in FIG. 15B) of the device B FIG. 16 is a schematic view illustrating a molded resin gear, on a surface of which a mark for use in phase matching is formed.

When a molded resin gear (or joint) is used for the rotation transmission device, it is preferable to perform molding such that a mark (such as a mark A illustrated in FIG. 16) for use in phase matching is formed on a surface of the molded resin gear because phase matching can be easily performed. In FIG. 16, the mark A has a triangle form but is not limited thereto. One vertex of the triangle mark A indicates a phase matching point. In such a rotation transmission device as illustrated in FIG. 7, the mark A is useful for assembling the rotation transmission device. In such a rotation transmission device as illustrated in FIG. 8, the mark A can be used as a mark for phase adjustment of the cavity (i.e., molding tool).

Figure 17:
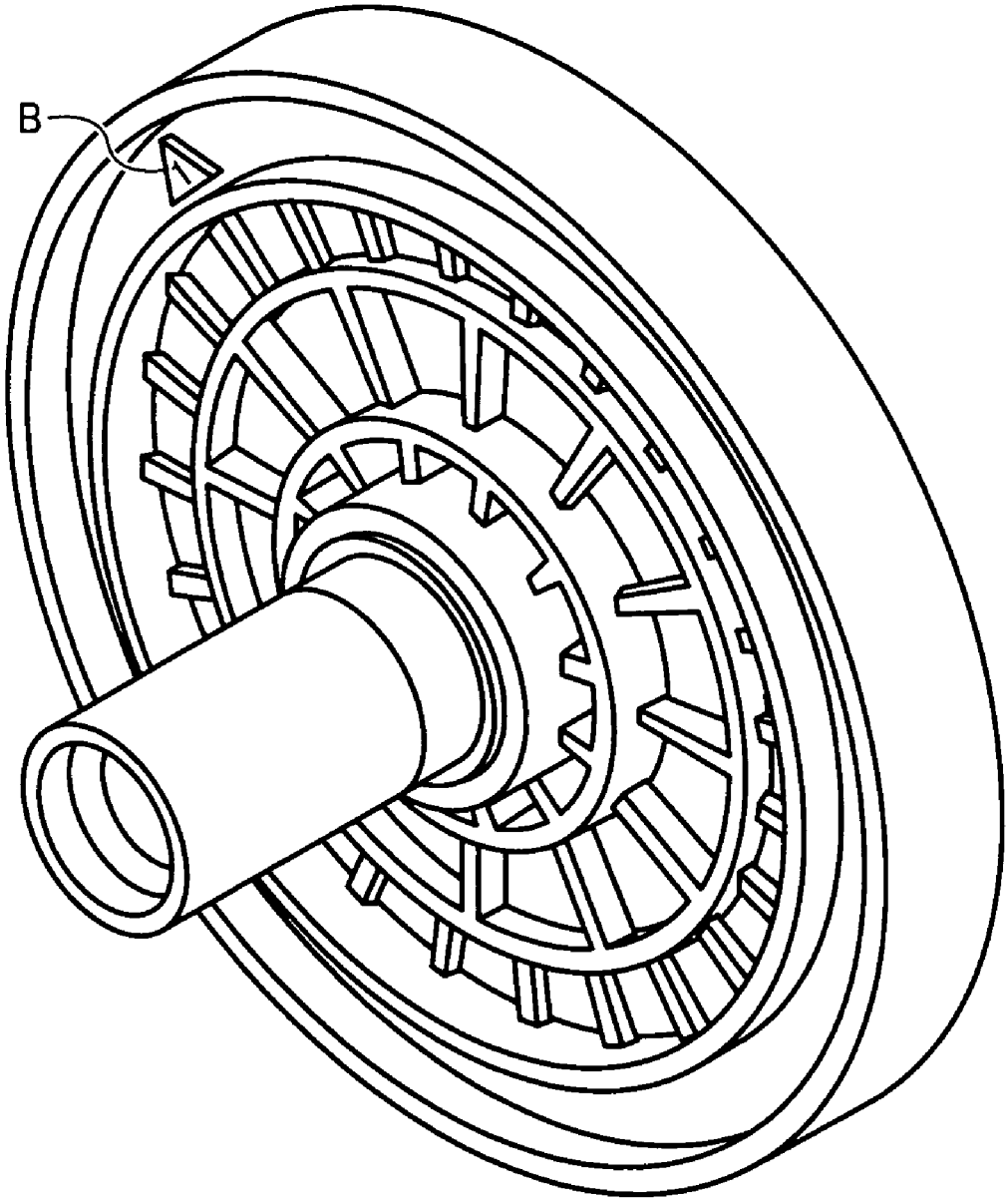

FIG. 17 is a schematic view illustrating another molded resin gear having a mark B thereon. The number "1" of the mark B denotes the number of the cavity used for molding the resin gear. When each of the gear and the joint is molded using plural cavities, it is preferable to combine a gear and a joint such that the amplitude difference is minimized. The number can be used for performing such assembling.

Figure 18:
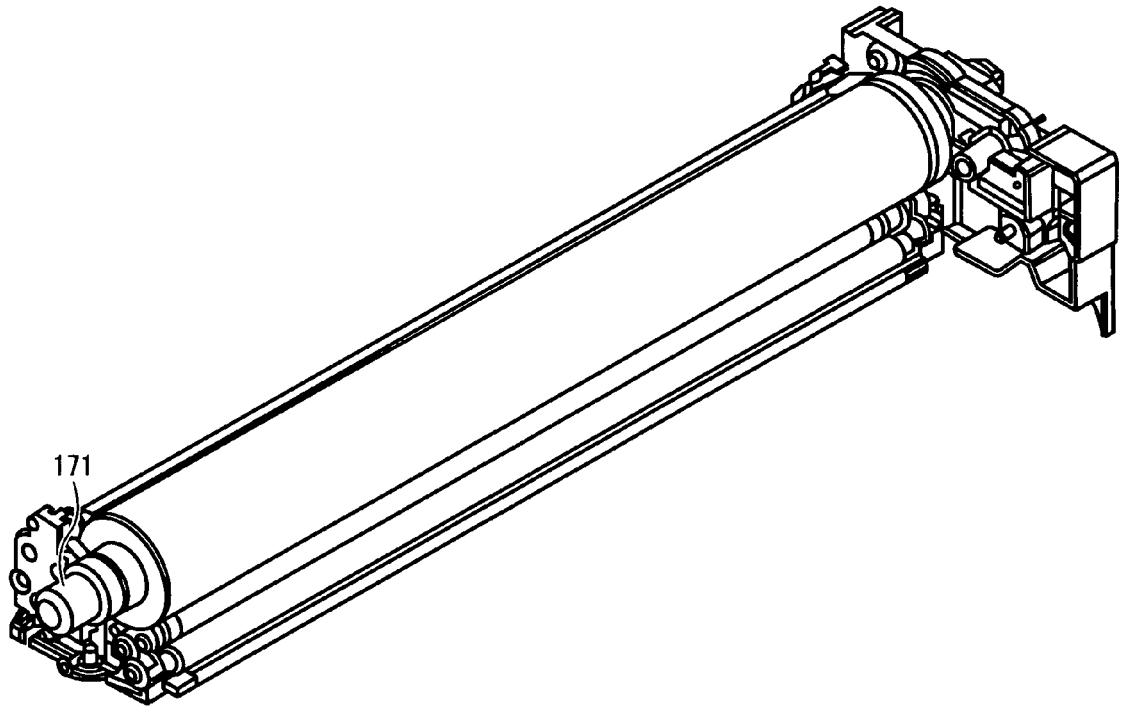
FIG. 18 is a schematic perspective view illustrating a photoreceptor unit for use in the image forming apparatus of the present invention.

FIG. 18 is a perspective view illustrating the photoreceptor unit of an example of the image forming apparatus.

In FIG. 18, numeral 171 denotes a photoreceptor-side joint (i.e., rotating-member-side joint). As illustrated in FIG. 18, the rotation transmission device of the present invention is used for driving the photoreceptor drum. Since the photoreceptor unit has the photoreceptor-side joint 171, the photoreceptor unit can be detachably attached in the thrust direction to the image forming apparatus. The rotation fluctuation of the photoreceptor drum, which bears a toner image thereof, largely influences image qualities (such as color misalignment). However, since the rotation transmission device of the present invention is used therefor, the rotation fluctuation of the photoreceptor drum can be reduced, thereby preventing formation of banded images (images in which a high density portion and a low density portion are periodically formed in the vertical direction), images having poor registration and multiple-color images having color misalignment.

Figure 19:
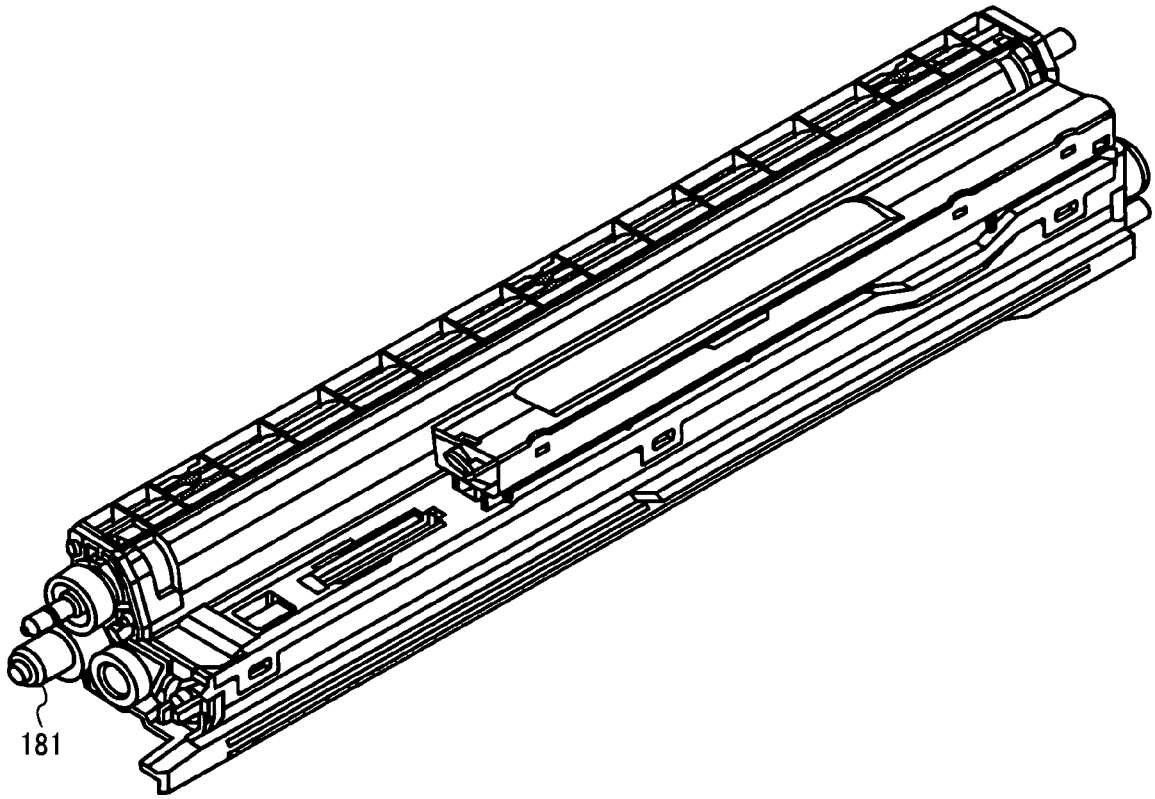
FIG. 19 is a schematic perspective view illustrating a developing unit for use in the image forming apparatus of the present invention.

FIG. 19 is a perspective view illustrating the developing unit (developing device) of an example of the image forming apparatus.

In FIG. 19, numeral 181 denotes a developing-unit-side joint (i.e., rotating-member-side joint). As illustrated in FIG. 19, the rotation transmission device of the present invention is used for driving the developing roller. Since the developing unit has the developing-unit-side joint 181, the developing unit can be detachably attached in the thrust direction to the image forming apparatus. The developing roller has a relatively large driving torque, and thereby rotational fluctuation tends to be easily caused. However, by using the rotation transmission device of the present invention therefor, variation of the amount of the developer (toner) supplied to the surface of the photoreceptor drum can be minimized. Therefore, formation of banded images can be prevented.

Figure 20:
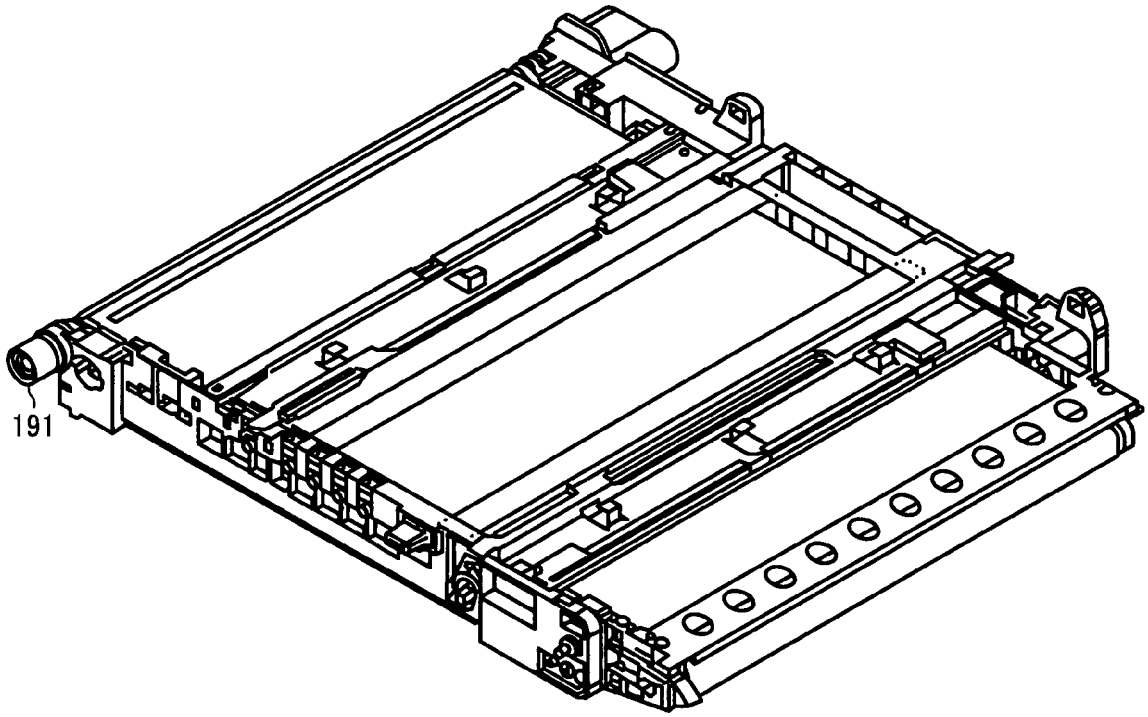
FIG. 20 is a schematic perspective view illustrating an intermediate transfer unit for use in the image forming apparatus of the present invention.

FIG. 20 is a perspective view illustrating the intermediate transfer unit of an example of the image forming apparatus.

In FIG. 20, numeral 191 denotes an intermediate-transfer-unit-side joint (i.e., rotating-member-side joint). As illustrated in FIG. 20, the rotation transmission device of the present invention is used for driving the intermediate transfer unit. Since the intermediate transfer unit has the joint 191, the intermediate transfer unit can be detachably attached in the thrust direction to the image forming apparatus. The rotation fluctuation of the intermediate transfer unit, which bears a toner image thereof, largely influences image qualities (such as color misalignment). However, since the rotation transmission device of the present invention is used therefor, the rotation fluctuation of the intermediate transfer belt can be reduced, thereby preventing formation of banded images, images having poor registration and multiple-color images having color misalignment.

In tandem color copiers and printers, the timing when a color toner image is transferred to the intermediate transfer belt is different from the timing when another color toner image is transferred to the intermediate transfer belt. Therefore, the driving mechanisms for the rotating members (such as photoreceptor drums) for forming Y, C, M and K color images are independently driven.

In addition, the image forming apparatus of the present invention includes plural image forming units (such as Y, C, M and K-color photoreceptor units, Y, C, M and K-color developing units, and combinations thereof), each of which has the rotation transmission device of the present invention and is detachably attachable to the image forming apparatus. In this case, each rotation transmission device is sometimes referred to as a rotation transmission unit in this application. Therefore, high quality images can be produced without forming banded images, images having poor registration and multiple-color images having color misalignment. In addition, each of the plural image forming units can be replaced with new one when damaged without replacing the other image forming units. Therefore, maintenance costs can be reduced.

As mentioned above, in the present invention the color misalignment caused by amplitude difference is reduced, resulting in prevention of color misalignment. When phase controlling is further performed, color misalignment is further improved.

This document claims priority and contains subject matter related to Japanese Patent Application No. 2007-295780, filed on Nov. 14, 2007, incorporated herein by reference.

Having now fully described the invention, it will be apparent to one of ordinary skill in the art that many changes and modifications can be made thereto without departing from the spirit and scope of the invention as set forth therein.

What is claimed is:

1. A rotation transmission device comprising:

a driving member configured to input a driving force;

a rotatable member; and a joint configured to transmit the driving force to the rotatable member, wherein the driving member, joint and rotatable member are coaxially arranged, and wherein the driving member are connected with the joint in such a manner that the phase of one-revolution fluctuation of the driving member is different from a phase of one-revolution fluctuation of the joint by an angle of $\pi$.

2. The rotation transmission device according to claim 1, wherein the driving member is connected with the joint using a shaft and a rotation stopper provided on the shaft.

3. The rotation transmission device according to claim 1, wherein the driving member and the joint are integrally molded so as to be coaxially arranged.

4. The rotation transmission device according to claim 3, wherein the driving member and the joint are integrally molded using a resin, and wherein at least the driving member has a mark including information on the phase of one-revolution fluctuation thereof.

5. The rotation transmission device according to claim 4, wherein the mark of the driving member further includes information on a number of a cavity used for molding the driving member.

6. The rotation transmission device according to claim 3, wherein the driving member and the joint are integrally molded using a resin, and wherein each of the driving member and the joint has a mark including information on the phase of one-revolution fluctuation thereof.

7. The rotation transmission device according to claim 6, wherein the marks of the driving member and the joint further include information on numbers of respective cavities used for molding the driving member and the joint.

8. A rotation transmission device comprising:

plural sets of rotation transmission units each including:

a driving member configured to input a driving force;

a rotatable member; and a joint configured to transmit the driving force to the rotatable member, wherein the driving member, joint and rotatable member are coaxially arranged in parallel in each of the plural sets of rotation transmission units, wherein the driving member is connected with the joint in such a manner that a phase of one-revolution fluctuation of the driving member is shifted from the phase of one-revolution fluctuation of the joint by an angle of $\pi$ to obtain plural composite waveforms of one revolution fluctuations of the plural sets of rotation transmission units and to determine a reference rotation transmission unit, which is one of the plural sets of rotation transmission units and has a composite waveform with a maximum amplitude, and wherein the driving member and the joint of each of the rotation transmission units other than the reference rotation transmission unit are connected while adjusting the phases of the composite waveforms of one-revolution fluctuations thereof such that amplitudes of the composite waveforms of the rotation transmission units other than the reference rotation transmission unit are substantially identical to the amplitude of the composite waveform of the reference rotation transmission unit.

9. The rotation transmission device according to claim 8, further comprising a controller for performing rotation phase controlling such that the composite waveforms of one-revolution fluctuations of the driving member and the joint of the plural rotation transmission units having substantially the same amplitude have substantially a same phase.

10. The rotation transmission device according to claim 8, wherein the driving member of each rotation transmission unit is connected with the joint thereof using a shaft and a rotation stopper provided on the shaft.

11. The rotation transmission device according to claim 8, wherein the driving member and the joint of each rotation transmission unit are integrally molded so as to be coaxially arranged.

12. The rotation transmission device according to claim 11, wherein the driving member and the joint are integrally molded using a resin, and wherein at least the driving member has a mark including information on the phase of one-revolution fluctuation thereof.

13. The rotation transmission device according to claim 12, wherein the mark of the driving member further includes information on a number of a cavity used for molding the driving member.

14. The rotation transmission device according to claim 11, wherein the driving member and the joint of each rotation transmission unit are integrally molded using a resin, and wherein each of the driving member and the joint has a mark including information on the phase of one-revolution fluctuation thereof.

15. The rotation transmission device according to claim 14, wherein the marks of the driving member and the joint further include information on numbers of respective cavities used for molding the driving member and the joint.

16. An image forming apparatus comprising:

a rotatable image bearing member configured to bear an electrostatic latent image thereon;

a developing device including a rotatable developing member configured to develop the electrostatic latent image with a developer including a toner to form a toner image on the image bearing member;

a transfer device including a rotatable transferring member configured to transfer the toner image on the image bearing member to a receiving material optionally via a rotatable intermediate transfer medium; and the rotation transmission device according to claim 1, wherein the rotatable member of the rotation transmission device is at least one of the image bearing member, developing member, transferring member and intermediate transfer medium.

17. An image forming apparatus comprising:

at least two rotatable image bearing members, each of which is configured to bear an electrostatic latent image thereon;

a developing device including at least two rotatable developing members configured to develop the electrostatic latent images with respective developers including different color toners to form color toner images on the respective image bearing member;

a transfer device including a rotatable transferring member configured to transfer the color toner images on the image bearing members to a receiving material optionally via a rotatable intermediate transfer medium; and the rotation transmission device according to claim 8, wherein the rotating members of the rotation transmission device are the at least two rotatable image bearing members or the at least two rotatable developing members.

18. The image forming apparatus according to claim 17, further comprising:

a controller configured to control stopping positions of the driving members of the rotation transmission device such that the phases of one-revolution fluctuations of the image bearing members.

* * * * *